United States Patent [19]

Natori

[11] Patent Number: 4,787,552

[45] Date of Patent: Nov. 29, 1988

[54] CASE FOR PACKAGING

[75] Inventor: Eiji Natori, Konosu, Japan

[73] Assignee: Chuo Kagaku Kabushiki Kaisha, Saitama, Japan

[21] Appl. No.: 103,479

[22] Filed: Sep. 30, 1987

[51] Int. Cl.[4] ..... B65D 45/00

[52] U.S. Cl. ..... 229/2.5 R

[58] Field of Search ..... 220/306; 229/2.5 R

[56] References Cited

U.S. PATENT DOCUMENTS

| | | | |
|---|---|---|---|
| 3,876,130 | 4/1975 | Haase | 229/2.5 R |
| 4,057,169 | 11/1977 | Payne | 229/2.5 R X |
| 4,079,880 | 3/1978 | Edwards | 229/2.5 R X |
| 4,132,344 | 1/1979 | Jewell | 229/2.5 R |
| 4,150,777 | 4/1979 | Cyr et al. | 229/2.5 R |
| 4,183,446 | 1/1980 | Davis | 229/2.5 R X |
| 4,193,496 | 3/1980 | Barratt | 229/2.5 R X |
| 4,253,600 | 3/1981 | Schubert | 229/2.5 R |
| 4,582,248 | 4/1986 | Bixler et al. | 229/2.5 R X |
| 4,653,685 | 3/1987 | Leary et al. | 229/2.5 R |

*Primary Examiner*—Steven M. Pollard
*Attorney, Agent, or Firm*—Jordan and Hamburg

[57] ABSTRACT

A case for packaging, manufactured according to the present invention, comprises a case body and a lid that engages with the case body, an engaging tab attached to the case body side and protruding outwardly, a slot attached to the lid side in such a manner that the engaging tab can be inserted in the slot, the outer surface of the engaging tab being formed of a first elevated face that protrudes substantially laterally to the direction of protrusion of the engaging tab, a step-gap part provided on the rear side, the outer surface of an edge part on the case body side that is positioned opposite to the engaging part, being formed of a second elevated face that protrudes in the same direction as the direction of protrusion of the first elevated face, the second elevated face being provided with a major cut line into which the engaging tab can be inserted longitudinally to the second elevated face, and sub cut lines that start at both ends of the major cut line towards the inside.

1 Claim, 6 Drawing Sheets

CASE FOR PACKAGING

BACKGROUND OF THE INVENTION

This invention relates to a case for packaging, widely used as a disposable lunchbox and for food-packaging cases in supermarkets, fast food outlets and other food shops.

This type of case for packaging, seen in the prior art, consists of a single-layer or multiple-layer plastic sheet of polyethylene, polypropylene, polyvinyl chloride, etc., whether semi-hard or hard, solid-wall or foamed-wall. Any of these raw materials is formed by vacuum forming, pressure forming, hot press or another suitable sheet-forming method.

Some of these cases for packaging, seen in the prior art, are formed to a specified shape by sheet-forming a raw material or water/oil-proof paper, using a hot press, etc.

Another type of packing case, used in the prior art, is formed by injecting a plastic into a thin-walled structure.

A case of such a type may be with or without lid.

A case with a lid is classified into a separate type and a connected type; in the former, the lid is completely separated from the case body and, in the latter, the lid 2 is connected to the case body 1 through a hinge 3 as shown in FIG. 3(*a*).

A practical example of the latter is described as follows. The case comprises a case body 1 and a lid 2, which is connected to the case body through a hinge 3 provided on one side with an open edge of the case body. An engaging tab 4 and a slot 5 are provided oppositely on the lid edge 21 and the case body edge 11 on the opposite side to the hinge.

In order to close and fix the lid 2 onto the case body 1, the lid is closed against the reactive force of the hinge 3 while the engaging tab 4 is bent downwards and inserted into the slot 5 (FIG. 3(*b*)).

This type of case for packaging is manufactured by forming a plastic sheet by either vaccum forming, pressure forming, etc., and then punching and trimming.

However, such a type of packaging case seen in the prior art has the following disadvantages.

With this example shown in the prior art, the engaging tab 4 is formed in a rectangular shape and inserted into the slot as cut in a straight line. Therefore, the fixing force of the lid 2 is so weak that, after the lid is closed, the engaging tab gradually come off while being driven by the counterforce of the hinge 3 against denting, thus the lid 2 often opens naturally. Therefore, the lid sometimes opens naturally even after being fixed.

In order to solve this problem, a case shown in FIGS. 3 (*c*) and (*d*) is proposed as a state-of-the-art development.

With a case shown in FIG. 3(*c*), a hook 41 is formed, laterally protruding from the top edge of the side of the engaging tab 4. When the tab is inserted in the slot 5, the hook is engaged with the edge of the slot for preventing disengagement of the tab.

According to this example of the prior art however, inserting and engaging operations are slightly time consuming to connect the tab 4 into the slot 5. In the extreme, the book 41 was often broken at the root during engaging operations, resulting in easy disengagement of the tab.

Another example of the prior art is shown in FIG. 3(*d*), in which an engaging tab 4 is formed substantially in a dovetail, whereby this tab is prevented from easy disengagement. With this example however, operations for insertion and engaging the engaging tab 4 were slightly laborious and time consuming.

Furthermore, another example of the prior art is shown in FIGS. 3 (*e*)~(*h*), where an engaging tab 4 is provided, protruding outwards from one side of the case body 1, while a side slit is equipped on the edge of one side of the lid 2 corresponding to this tab, thereby the tab is configured to enter the slot easily.

With this example seen in the prior art, operations for closing the lid 2 and fixing it to the case body 1 are carried out as follows. When the lid 2 is closed first, the lower face of the lower edge 51 in the slot 5 comes in contact and is supported by the upper face of the tab 4 (FIG. 3(*f*)). When the side wall on the tab 4 side of the case body 1 is deflected by pressing with a fingertip toward the inside of the case body as shown by the chain line in FIG. 3(*f*), the top of the tab moves back on the left side from underneath the lower edge 51 for release. When this pushing pressure is released after the above, the side wall, as deflected as shown in FIGS. (*g*) and (*h*), returns back in place while the tab 4 enters the slot 5. At this time, the lower face of the tab comes in contact with and is fixed on the upper face of the lower edge 51 of the slot.

Next, operations for opening the lid 2 are explained in the following. The side wall on the tab 4 side of the case body 1 is again pushed with a fingertip to the inside of the case body while deflecting this part and releasing the tab, the tab is disengaged from the slot 5, thus the lid becomes openable.

A lid-fixing structure, shown in FIGS. 3 (*e*)~(*h*), is advantageous in that operations for fixing or releasing the lid can be performed at one touch. However, the structure still retains the following two defects.

The first defect is explained now. Operations for engaging with and releasing the slot 5 should be conducted smoothly without excess friction during deflection caused by pressing the wall on the tab side of case body 1. For this purpose, this slot must be drilled beforehand with a considerably large hole having sufficient width in relation to the size of the tab. In consequence, the size of the slot 5 becomes fairly large to allow insertion inside and outside of the case as shown in FIGS. 3 (*g*) and (*h*) with the lid closed. Therefore, the sealing of the case is greatly damaged.

Regarding the second defect, it is required to set the length of protrusion for the tab 4 to be rather long, namely the length of inserting the tab into the slot 5 in order to maintain firm fixation of the lid. As a result, it has been required to make the deflection quantity of the side wall rather large in the tab of the case body due to pressing for releasing or releasing operation of the lid.

DETAILED DESCRIPTION OF THE INVENTION

Figure 1:
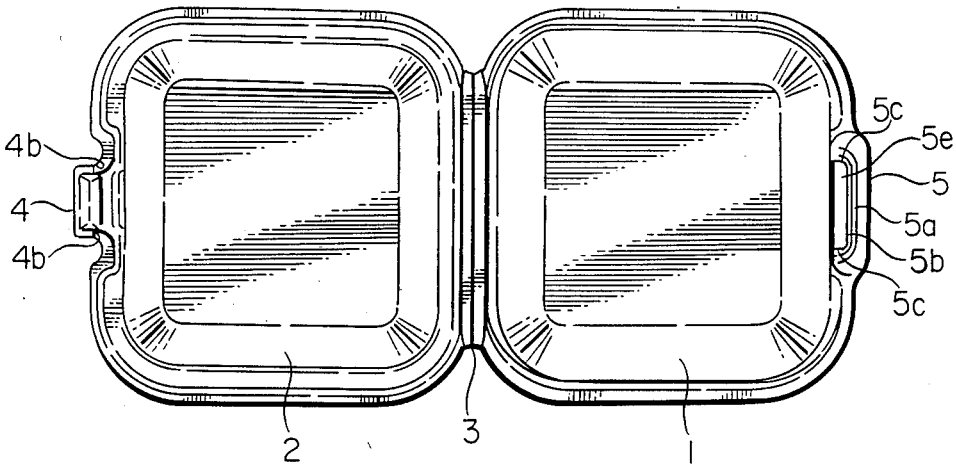
Figure 1:
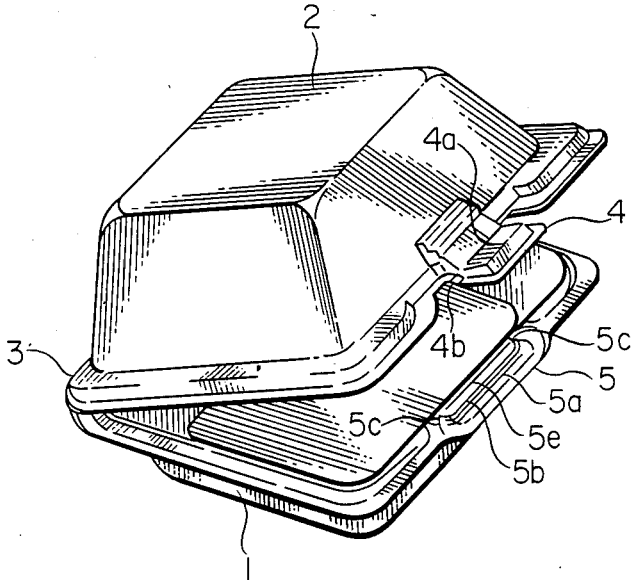
Figure 1G:
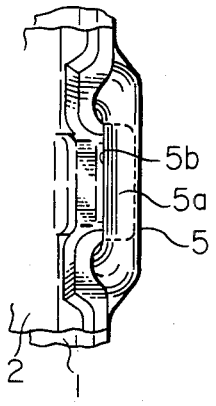
Figure 1E:
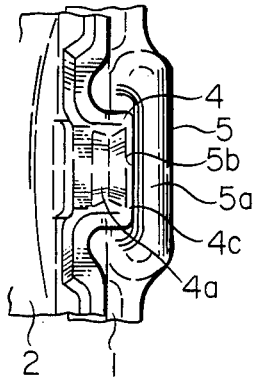
Figure 1C:
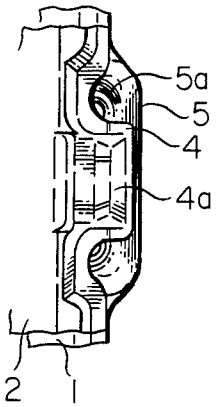
Figure 1H:
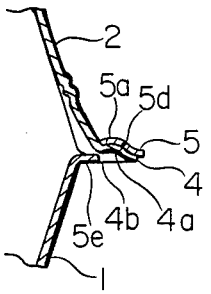
Figure 1F:
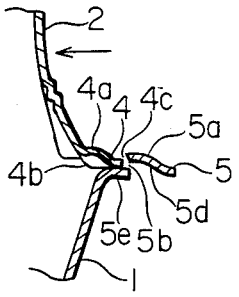
Figure 1D:
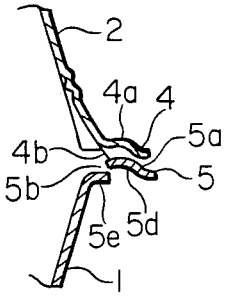
Figure 1I:
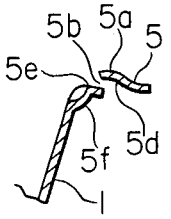

The first objective of the present invention is to make operation of fixing and releasing the lid easier.

The second objective of the present invention is to make operation of fixing and releasing the lid easier without harming the hermetical sealing of the case.

The third objective of the present invention is to operate the lid for fixing and releasing without making the deflection of the case larger.

The case for packaging, manufactured according to the present invention, comprises a case body and a lid that is equipped to cover the case body. On the case body side and the lid side there are an outwardly protruding engaging tab and a slot in which the engaging tab can be inserted, in an opposite positional relationship.

The outer surface of the engaging tab is formed as an elevated face that protrudes substantially laterally to the direction of protrusion, on the rear side of which there is a step-gap part.

The slot is provided with an elevated face at the outer surface of the edge part on the case body side or lid side, oppositely positioned to the tab, the elevated face being protruded in the same direction as the protrusion of the elevated face of the tab. On this elevated face of the slot, a major cut line is provided with such a length that the tab can be inserted in its longitudinal direction. In addition, a subcut line is created from both ends of the major line, directed inwardly.

The features of the present invention will be more deeply understood by describing them while referring to the drawings.

FIGS. 1 (*a*)~(*i*) show the first embodiment of the present invention, in which FIG. 1 (*a*) is a plan view for showing the lid open. FIG. 1 (*b*) is an oblique view for indicating a state of the way of closing the lid. FIGS. 1 (*c*)~(*h*) stepwise show the procedures of engaging operations for the tab in relation to the slot. FIG. 1 (*i*) is a sectional view for a deformation example of a pressure piece.

Figure 2:
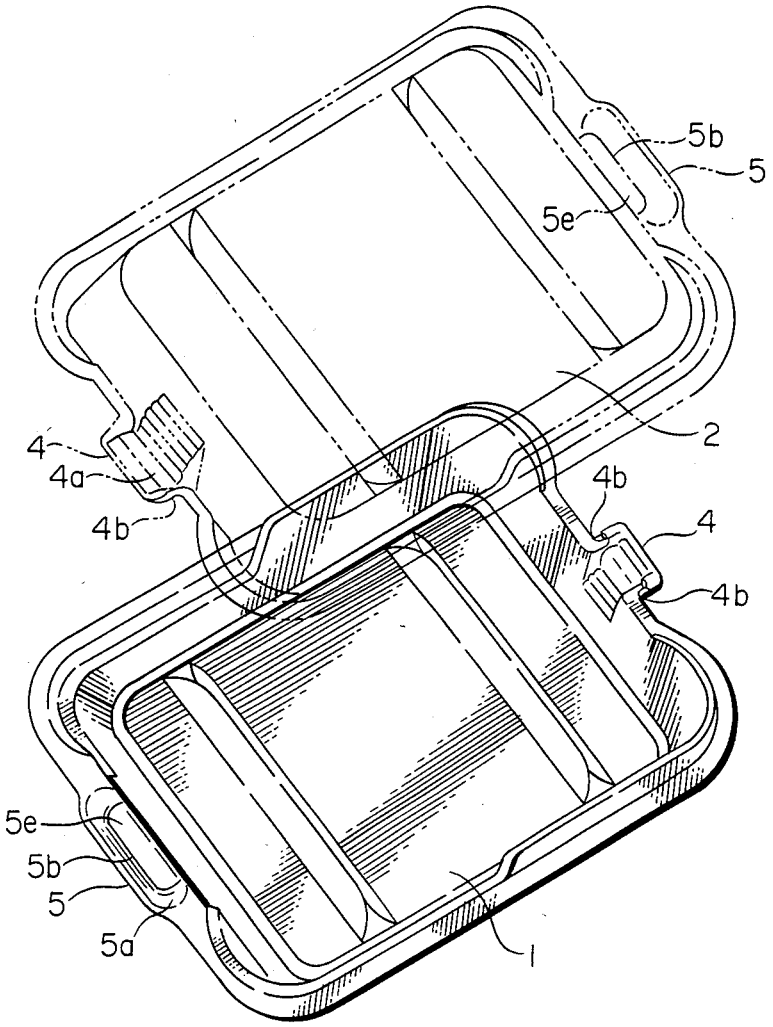
Figure 2:
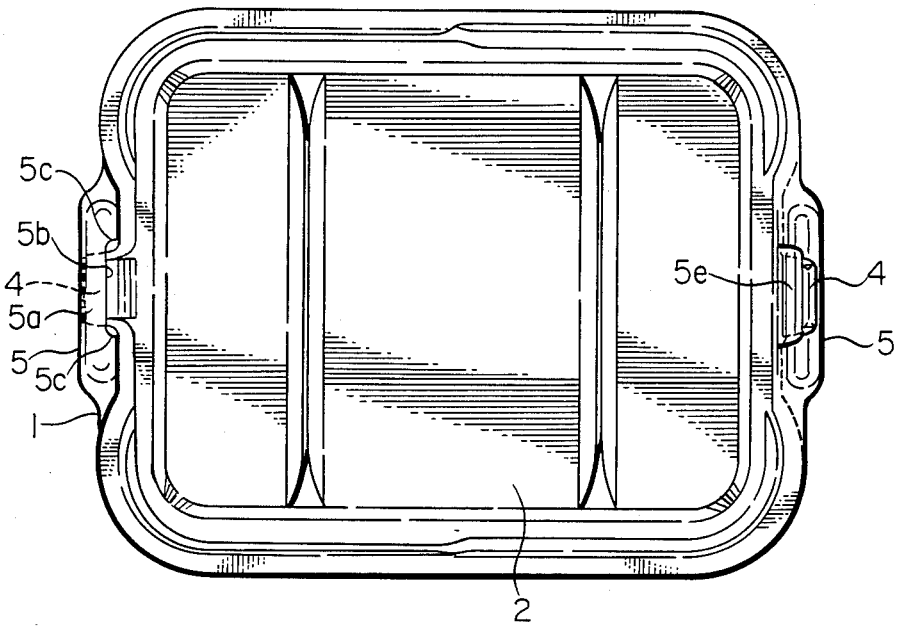

FIGS. 2 (*a*)~(*b*) show the second embodiment of the present invention, in which (a) and (b) are oblique and plan views for showing the lid closed, respectively.

Figure 3:
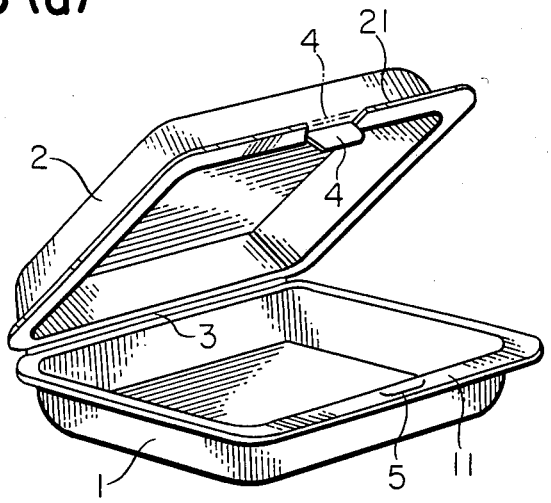
Figure 3:
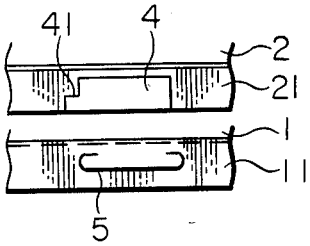
Figure 3:
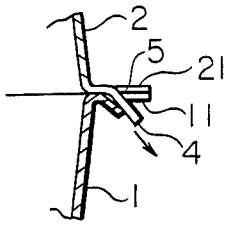
Figure 3:
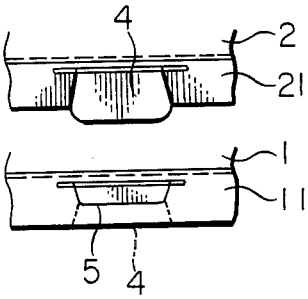
Figure 3:
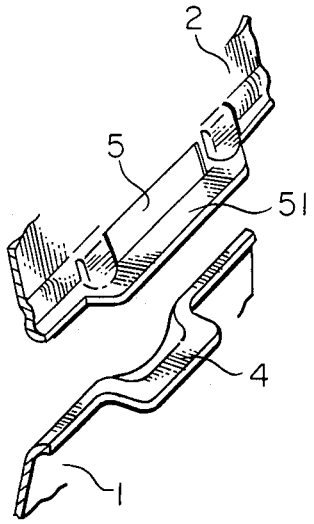
Figure 3:
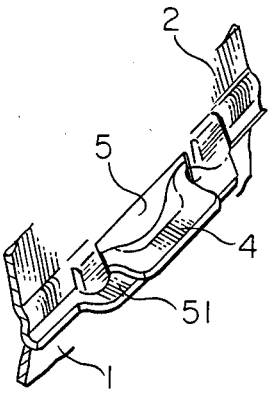
Figure 3:
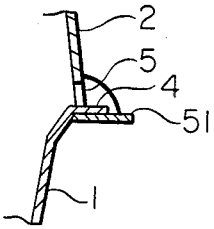
Figure 3:
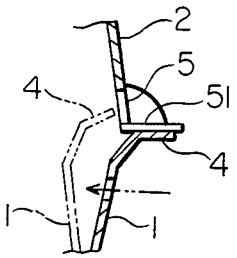

FIGS. 3 (*a*)~(*h*) indicate an example according to the prior art, where (a) and (b) denote an oblique and sectional view of the lid-fixing structure. FIG. 3 (*c*) and (*d*) show other examples of the lid-fixing structure, FIGS. 3 (*e*)~(*h*) denote still other examples of the lid-fixing structure.

DETAILED DESCRIPTION FOR PREFERRED EMBODIMENTS OF THE PRESENT INVENTION

The first embodiment is described referring to FIGS. 1 (*a*)~(*i*).

The case of this embodiment comprises a case body 1 and a lid 2 formed integrally to one side of the opening edge of this case body, through a hinge 3. This case is composed of a formed plastic sheet.

An engaging tab 4, for fixing the lid, is outwardly protruded substantially at the center of the edge part, located opposite to the hinge 3, of the lid 2. The upper face of this tab is formed in a concave rib-like elevated face 4*a* that is protruding in a direction substantially rectangular to the direction of tab protrusion. At the root in the rear side of the tab 4, a step-gap part 4*b* is provided.

A tab slot 5 is equipped at a position at which the engaging tab 4 can come in contact, substantially at the center of the edge part on the side opposite to the hinge 3, in the case body 1. The upper face of this slot is formed in an elevated face protruded in the same direction as that of the protrusion of the elevated face 4*a* of the tab. The elevated face 5*a* is provided with a major cut line 5*b* having such a length that the tab 4 can be inserted substantially at each center, in the longitudinal direction of the elevated face 5*a* (up/down direction of FIG. 1 (*a*)) on the elevated face 5*a*. In addition, rather short minor cut lines 5*c*, 5*c* are cut from both ends of the major cut line in a direction towards the inside of the case. An inner part of the slot 5, enclosed by the major cut line 5*b* and minor cut lines 5*c*, 5*c* functions as a pressure piece 5*e*.

Next, the operations of the lid 2 for engaging and releasing the lid are described in the following.

Lid-fixing operation is first described.

When the lid 2 is closed, the tab 4 is superimposed on the slot 5 (FIGS. 1(*c*), (*d*)).

The side wall part on the tab 4 side of the lid 2 is pushed and deflected inwardly (the direction of the arrow shown in FIG. 1(*f*)) from this state, thereby driving the tab 4 backwards in regard to the slot 5 and placing the top side 4*c* of the tab at the major cut line 5*b* of the slot (FIGS. 1(*e*), (*f*)).

After the above, the top side of the tab 4 is inserted in the major cut line 5*b*. With the tab 4 completely inserted, the elevated face 4*a* of the tab 4 is engaged with a recess face 5*d* on the rear side of the elevated face 5*a* in the slot 5. At this time, a pressure piece 5*e* in the slot 5 is pressed downwards by the rear face of the tab 4, while deflecting by its resiliency. A reactive force of the pressure piece, associated with this pressing action, is applied to the rear face of the tab 4. In consequence, the elevated face 4*a* of the tab positively pushed the recess face 5*d* in the rear face of the elevated face 5*a* of the slot 5. In addition, the top side of the pressure piece 5*e* is engaged with a step-gap part 4*b* on the rear side of the tab 4 (FIGS. 1(*g*), (*h*)).

The tab 4 is firmly fixed into the slot, being prevented from disengaging, because the elevated face 4*a* of the tab 4 engages with the recess face 5*d* of the elevated face 5*a* in the slot, also because the pressure piece 5*e* positively presses both faces 4*a*, 5*d* and because the step-gap 4*c* of the tab engages with the top side of the pressure piece tab 5*e*. As a result, fixed state is certainly maintained. As lid-fixing state is maintained always and at any time, the outwardly protruding length of the tab 4 may be small, which facilitates lid-fixing and releasing operations. Since the length of the outwardly protruding tab 4 is made smaller, the amount of deflection in the side wall part on the tab 4 side of the lid, to be carried out during lid-fixing or releasing operation, is reduced. Furthermore, the case can be hermetically sealed completely because such a large hole need not be drilled in the hinge part between the tab 4 and the slot 5, where the hole connects the inside of the case to the outside.

To release the fixed lid, the side wall part on the tab 4 side of the lid 2 is pressed to the inside of the case and deflected, then the top side 4*b* of the tab is removed from the major cut line 5 in the slot 5, where the side 4*b* is inserted.

With a case manufactured according to the present invention, the tab 4 may be created in one side of the case body while equipping its slot 5 on the lid 5 side.

With a view to smoothly inserting the top side of the tab 4 into the major cut line 5*b* (FIG. 1(*f*)), it is preferred that the pressure piece 5*e* is formed previously to locate it slightly lower than the elevated face 5*a* on the outside, so that the gap of the major cut line 5*b* becomes substantially the same thickness as the top side of the tab 4, as shown in FIGS. 1(*d*), (*f*).

Moreover, a rib 5*f* may preferably be equipped at the root of the pressure piece 5*e* as shown in FIG. 1(*i*), thus preventing yielding and maintaining resiliency.

Another embodiment of the present invention is described referring to FIGS. 2(*a*), (*b*).

In this embodiment, the case comprises a vessel body 1 and a lid 2 in the same shape as molded with the same mold. This case is structured in such a shape that one of the two case halves in the same shape is used as a case body 1 while using the other case half as a lid 2 to be coupled to the case body after overturning and rotating by 180°, thus both 1, 2 can just fit with each other in complete engagement. In addition, a tab 4 and a slot 5 that are protruding outwards are equipped at the center prts of mating two sides of the case body 1 and the lid 2.

Referring to FIG. 2(*a*) that shows operating status, one of the two case halves of the same shape is used as a case body 1 while covering the other case half as a lid 2 after overturning and rotating by 180°. Thus, the tab 4 and the slot 5 of the case body 1 are placed immediately under the slot 5 and the tab 4 of the lid 2, in superimposition, respectively. Now, these two pairs of tab 4 and slot 5 are engaged in the same way as shown in FIG. 1. As a result, a case shown in FIG. 2(*b*) is assembled, in which the lid 2 is fixed on the case body 1.

What is claimed is:

1. A case for packaging, comprising an outwardly protruding tab, a slot into which the engaging tab can be inserted, the engaging tab and the slot being placed in an opposing and engageable manner on the case body side and the lid side, respectively, the outer surface of the engaging tab is formed of a first elevated face that protrudes substantially laterally to the direction of protrusion and a step-gap part that is provided on the rear side, the slot is provided with a second elevated face on the outer surface of the case body side or on the edge part on the lid side, in such a manner that the elevated face is opposite to and engageable with the engaging tab, the second elevated face protruding in the same direction as the direction of the protrusion of the engaging tab, the second elevated face being provided with a major cut line of such a length that the engaging tab can be inserted in the longitudinal direction to the second elevated face, and the second elevated face being provided also with sub cut lines that start from both ends of the major cut line, towards the inside.

* * * * *